US008743000B2

(12) United States Patent
Gagnon et al.

(10) Patent No.: US 8,743,000 B2
(45) Date of Patent: Jun. 3, 2014

(54) PHASE ELEMENT COMPRISING A STACK OF ALTERNATING CONDUCTIVE PATTERNS AND DIELECTRIC LAYERS PROVIDING PHASE SHIFT THROUGH CAPACITIVE AND INDUCTIVE COUPLINGS

(75) Inventors: Nicolas Gagnon, Gatineau (CA); Aldo Petosa, Nepean (CA); Derek A. McNamara, Ottawa (CA)

(73) Assignee: Her Majesty the Queen in Right of Canada, as Represented by the Minister of Industry, through the Communications Research Centre Canada, Ottawa (CA)

( * ) Notice: Subject to any disclaimer, the term of this patent is extended or adjusted under 35 U.S.C. 154(b) by 367 days.

(21) Appl. No.: 12/805,376

(22) Filed: Jul. 28, 2010

(65) Prior Publication Data

US 2011/0025432 A1 Feb. 3, 2011

Related U.S. Application Data

(60) Provisional application No. 61/230,180, filed on Jul. 31, 2009.

(30) Foreign Application Priority Data

Aug. 4, 2009 (CA) ..... 2674785

(51) Int. Cl.
*H01Q 15/00* (2006.01)
*H01Q 15/02* (2006.01)

(52) U.S. Cl.
CPC ..... *H01Q 15/0033* (2013.01); *H01Q 15/02* (2013.01)
USPC ..... 343/753; 343/909

(58) Field of Classification Search
CPC ..... H01Q 15/0033; H01Q 15/02
USPC ..... 343/909, 753, 756, 754
See application file for complete search history.

(56) References Cited

U.S. PATENT DOCUMENTS

| | | | | |
|---|---|---|---|---|
| 4,387,377 | A * | 6/1983 | Kandler | 343/756 |
| 4,684,952 | A | 8/1987 | Munson et al. | 343/700 MS |
| 5,434,587 | A * | 7/1995 | Hannan | 343/909 |
| 6,987,591 | B2 | 1/2006 | Shaker et al. | 359/15 |
| 2005/0104791 | A1 * | 5/2005 | Sun et al. | 343/756 |
| 2008/0088525 | A1 * | 4/2008 | Jonathan | 343/909 |

OTHER PUBLICATIONS

Abella et al. "Artificial dielectric lens antennas: Assessment of their potential for space applications", Sep. 1993.

(Continued)

*Primary Examiner* — Benny Lee
(74) *Attorney, Agent, or Firm* — Teitelbaum & MacLean; Neil Teitelbaum; Doug MacLean

(57) ABSTRACT

A thin electromagnetic phase shifting element, named phase and amplitude shifting surface (PASS), is disclosed. The PASS is capable of independently altering both the phase and the amplitude distribution of the electromagnetic fields propagating through the structure. The element comprises a few patterned metallic layers separated by dielectric layers. The patterns of the metallic layers are tuned to locally alter the phase and/or the amplitude of an incoming electromagnetic wave to a prescribed set of desired values for the outgoing electromagnetic wave. The PASS can be applied to design components such as gratings, lenses, holograms, and various types of antennas in the microwave, millimeter wave and sub-millimeter wave.

20 Claims, 14 Drawing Sheets

(56) References Cited

OTHER PUBLICATIONS

Shaker , "Thick volume hologram for microwave frequency band: design, fabrication, and test", IEE Proc.—Microw, Antennas Propag., vol. 153, No. 5, Oct. 2006, p. 412-419.
B.R. Brown, A.W. Lohmann, "Complex Spatial Filtering with Binary Masks", Applied Optics, vol. 5, No. 6, pp. 967-969, Jun. 1966.
B.R. Brown, A.W. Lohmann, "Computer-Generated Binary Holograms", IBM Journal of Research and Development, vol. 13, No. 2, pp. 160-168, Mar. 1969.
M.R. Chaharmir, S. Raut, A. Ittipiboon, A. Petosa, "Cylindrical Multilayer Transmitarray Antennas", International URSI Commission B Electromagnetic Theory Symposium, EMTS-2007, Ottawa, Canada, Jul. 2007 (digital format).
S. B. Cohn, "Lens-Type Radiators", Antenna Engineering Handbook, H. Jasik, Ed. New York, USA: McGraw-Hill, 1961, Ch. 14.
R.E. Collin, "Field Theory of Guided Waves", IEEE Press, 2nd Ed., 1991, Chap. 12.
M. Elsherbiny, A.E. Fathy, A. Rosen, G. Ayers, S.M. Perlow, "Holographic Antenna Concept, Analysis, and Parameters", IEEE Transactions on Antennas & Propagation, vol. 52, No. 3, pp. 830-839, Mar. 2004.
J.W. Goodman, "An Introduction to the Principles and Applications of Holography", Proc. IEEE, vol. 59, No. 9, pp. 1292-1304, Sep. 1971.
J.W. Goodman, "Introduction to Fourier Optics", Second Edition, McGraw-Hill, Inc., New York, NY, 1996.
Y.J. Guo, S.K. Barton, "Fresnel Zone Antennas", Kluwer Academic Publishers, 2002, Boston, MA.
H.D. Hristov, "Fresnel Zones in Wireless Links, Zone Plate Lenses and Antennas", Artech House, 2000, Norwood, MA.
J. Huang, J.A. Encinar, "Reflectarray Antennas", Wiley-IEEE Press, 2007, Hoboken, New Jersey.
K. Iizuka, M. Mizusawa, S. Urasaki, H. Ushigome, "Volume-Type Holographic Antenna", IEEE Transactions on Antennas and Propagation, vol. 23, No. 6, pp. 807-810, Nov. 1975.
W. E. Kock, "Microwave Holography", Microwaves, vol. 7, No. 11, pp. 46-54, Nov. 1968.
K. Lévis, A. Ittipiboon, A. Petosa, L. Roy, P. Berini, "Ka-band Dipole Holographic Antennas", IEE Proceedings on Microwaves, Antennas and Propagation, vol. 148, No. 2, pp. 129-132, Apr. 2001.
D.T. McGrath, "Planar Three-Dimensional Constrained Lens", IEEE Transactions on Antennas and Propagation, vol. 34, No. 1, pp. 46-50, Jan. 1986.
B.A. Munk, "Frequency Selective Surfaces: Theory and Design", Wiley, 2000.
A. Petosa, A. Ittipiboon, "Comparison of an Elementary Hologram and Fresnel Zone Plate", The Radio Science Bulletin, No. 324, pp. 29-36, Mar. 2008.
D.M. Pozar, "Flat Lens Antenna Concept Using Aperture Coupled Microstrip Patches", IEE Electronics Letters, vol. 32, No. 23, pp. 2109-2111, Nov. 1996.
D. Sievenpiper, L. Zhang, R.F.J. Broas, N.G. Alexopolous, E. Yablonovitch, "High-impedance electromagnetic surfaces with a forbidden frequency band", IEEE Transactions on Microwave Theory and Techniques, vol. 47, No. 11, pp. 2059-2074, Nov. 1999.
L. Thourel, "The Antenna", John Wiley and Sons, 1960.
G. Tricoles, E.L. Rope, "Binary, Detour Phase, Microwave Holography," in G-MTT International Microwave Symposium Digest, vol. 70, No. 1, pp. 124-125, May 1970.
W.M. Waters, "An Electronic Half-Tone Image Recording Technique", Proceedings of the IEEE, vol. 54, No. 2, pp. 319-320, Feb. 1966.

* cited by examiner (a)

(b)

PHASE ELEMENT COMPRISING A STACK OF ALTERNATING CONDUCTIVE PATTERNS AND DIELECTRIC LAYERS PROVIDING PHASE SHIFT THROUGH CAPACITIVE AND INDUCTIVE COUPLINGS

CROSS-REFERENCE TO RELATED APPLICATIONS

The present invention claims priority from U.S. Provisional Patent Application No. 61/230,180, filed Jul. 31, 2009, and Canadian Patent Application No. 2,674,785, filed Aug. 4, 2009, which are incorporated herein by reference.

TECHNICAL FIELD

The present invention relates to devices for altering a wavefront of an electromagnetic wave, and in particular to phase or amplitude shifting elements for redirecting, focusing, or collimating an electromagnetic wave.

BACKGROUND OF THE INVENTION

Electromagnetic waves are widely used in areas ranging from communication and radiolocation to TV broadcasting, imaging, medical treatment, and food processing. Electromagnetic waves in the microwave, millimeter-wave, and in sub-millimeter wave ranges are particularly useful for the purposes of communication due to relatively high carrier frequency and associated ease of beaming the wave and comparatively large information carrying capacity. Electromagnetic waves in the sub-millimeter wavelength region, or so-called terahertz radiation, are presently used in non-invasive through-imaging applications.

Devices for collimating or focusing electromagnetic waves are important elements of many types of antenna devices. Quite often, the term "antenna" is used in the prior art to denote the collimating or focusing elements themselves. Antennas vary widely in their construction. One of the most traditional and well-known antennas is a reflective antenna, such as paraboloid reflector antennas for a satellite TV reception. Transmission antennas, such as hyperboloid dielectric lenses, are also known, although they are not as widely used due to their larger mass as compared to reflective antennas. Furthermore, holographic principles have been applied at microwave frequencies for designing low-profile scattering surfaces for high-gain reflective and transmissive antenna applications. A review of microwave holography can be found in an article by W. E. Kock entitled "Microwave Holography", *Microwaves*, vol. 7, no. 11, pp. 46-54, November 1968, which is incorporated herein by reference.

Reflective antennas can be constructed in form of concave reflectors, Fresnel zone plates, or in form of so called "artificial impedance" reflectors. Fresnel zone plates and artificial impedance reflectors are thinner than concave reflectors, however they generally suffer from a lower aperture efficiency, as well as somewhat limited bandwidth. A considerable effort has been devoted to developing a so-called "reflectarray" technology, where the curved reflector surfaces are replaced by thin flat panels of microstrip patches. For example, in U.S. Pat. No. 4,684,952 by Munson et al., which is incorporated herein by reference, a microstrip reflectarray for satellite communications is disclosed. The major disadvantage of reflectarrays is their limited bandwidth. Furthermore, due to the difficulty in reproducing the required interference patterns at microwave frequencies, holographic antennas, artificial impedance antennas, and reflectarrays generally suffer from lower aperture efficiencies than conventional reflectors or dielectric lenses.

Each technology has its strengths and weaknesses, and the requirements of the application will usually dictate the type of antenna to be selected. Conventional paraboloid reflectors and dielectric lenses in general have a higher radiation efficiency, but they require a larger volume than planar arrays. Planar arrays are attractive for their low profile and capability for electronic beam scanning, but these advantages come at the expense of complex feed network design and reduced radiation efficiency. For fixed-beam applications, conventional reflectors and lenses usually have superior electrical performance and would probably always have been selected if it were not for the larger volumes they occupy.

Regardless of technology used, transmissive antennas offer certain advantages over reflective ones, such as the elimination of aperture blockage by the feed antenna and reduced sensitivity to manufacturing tolerances, both of which are important for higher frequency designs. However, less work has been carried out on reducing the volume of transmissive antennas. In most cases, transmissive antennas are lenses formed out of dielectric material with a plano-hyperbolic cross-section. These lenses are relatively thick, especially for designs with small focal length-to-diameter (F/D) ratios. The lenses can be zoned to reduce the overall thickness, but the zoning results in reduced bandwidth and aperture efficiency of the lens.

Referring to FIG. 1A, a prior-art dielectric lens 100 is shown. The dielectric lens 100 is shaped to transform a planar wavefront 101 into a spherical wavefront 102 or vice versa. The dielectric lens 100 introduces a phase delay at its center 103 larger than a phase delay at its edge 104, whereby the spherical wavefront 102 is formed. Factors affecting the performance of the dielectric lens 100 include the impedance mismatch at the boundaries and the transmission loss in the material of the dielectric lens 100. As noted above, the dielectric lens 100 has a comparatively good performance, although it is too bulky and heavy for many applications.

Referring now to FIG. 1B, a prior-art Fresnel zone plate 105 is shown. The Fresnel zone plate 105 operates by blocking portions of the incoming wavefront 101 by metal structures 106 to obtain the spherical wavefront 102 due to diffraction. The Fresnel zone plate 105, although being much thinner and lighter than the dielectric lens 100, has a focusing efficiency of about 6 dB worse than a dielectric lens 100, because approximately half of the incoming electromagnetic energy is blocked by the metal structures 106 of the Fresnel zone plate 105.

An effort has been undertaken in the prior art to provide a transmissive antenna that would combine the compactness of the Fresnel zone plate 105 with the performance of the dielectric lens 100. Two approaches have been tried in the prior art. One approach is to use so called "artificial dielectric" as a material for the lens. The artificial dielectric is a composite material consisting of a dielectric host containing an array of metal inclusions, thus modifying an effective dielectric constant of the composite material. By spatially varying the density of the inclusions to make the effective refractive index of the lens higher at the lens center than at its edges, the desired focusing property of the lens can be achieved without having to make the lens as thick as the traditional dielectric lens 100.

Volume holographic elements can also be created using the artificial dielectric approach. For example, in U.S. Pat. No. 6,987,591 by Shaker et al., incorporated herein by reference, an artificial dielectric-type volume hologram is disclosed. Disadvantageously, the artificial dielectric approach, although reducing the antenna thickness, still results in a relatively thick, heavy, and expensive antenna device, because many layers of metal inclusions, typically 80 or more, are required for a satisfactory performance to be obtained.

Another prior-art approach to reduce thickness of a transmissive-type antenna is to use an array of microstrip patches. Turning to FIG. 1C, a microstrip device 107 is schematically shown in a side view. The microstrip device 107 includes an array of resonant patch receivers 108A, 108B, 108C, 108D, and 108E coupled to an array of microstrip delay lines 109A, 109B, 109C, 109D, and 109E coupled to an array of resonant patch transmitters 110A, 110B, 110C, 110D and 110E, respectively. The delay time of the microstrip delay lines 109A to 109E varies, increasing in going from the top microstrip delay line 109A to the center microstrip delay line 109C, and decreasing in going from the center microstrip delay line 109C to the bottom microstrip delay line 109E. The microstrip delay times are selected so that the planar wavefront 101 is transformed into the spherical wavefront 102 or vice-versa. One drawback of the microstrip device designs is that the resonant patch receivers 108A to 108E have to be spatially separated from corresponding resonant patch transmitters 110A to 110E by a gap 111 containing the microstrip delay lines 109A to 109E, which increases the mechanical complexity and thickness of the microstrip device 107. Furthermore, the separation between the elements on the same layer (108A to 108E; 110A to 110E) has to be about one wavelength, which results in a significant quantization error. Another drawback is a reduced bandwidth due to the resonant character of the patch receivers 108A to 108E and the patch transmitters 110A to 110E.

Yet another prior-art approach to create a low-profile transmissive antenna is to use so-called transmitarrays. Transmitarrays use a small number of thin dielectric layers to emulate a lens behaviour. A prototype transmitarray consisting of four dielectric sheets upon which thin cross dipoles were printed was demonstrated by M. R. Chaharmir et al. in an article entitled "Cylindrical Multilayer Transmitarray Antennas," *International URSI Commission B Electromagnetic Theory Symposium*, EMTS-2007, Ottawa, Canada, July 2007, incorporated herein by reference. One drawback with current transmitarray designs is the requirement for an air gap between dielectric layers of one tenth of a wavelength or more, to maximize radiation efficiency. This increases the mechanical complexity of the device and does not allow for achieving an optimum thickness reduction. Nevertheless, a transmitarray is usually much thinner than the shaped dielectric lens 100.

Finally, it is important to mention research carried out on the use of holographic techniques for designing low-profile antennas and lenses at microwave frequencies, as disclosed in an article by K. Iizuka et al. entitled "Volume-Type Holographic Antenna," *IEEE Transactions on Antennas and Propagation*, vol. 23, no. 6, pp. 807-810, November 1975; in an article by K. Lévis et al. entitled "Ka-band Dipole Holographic Antennas," *IEE Proceedings on Microwaves, Antennas and Propagation*, vol. 148, no. 2, pp. 129-132, April 2001, and in an article by M. Elsherbiny et al. entitled "Holographic Antenna Concept, Analysis, and Parameters," *IEEE Transactions on Antennas and Propagation*, Vol. 52, No. 3, pp. 830-839, March 2004, all of which are incorporated herein by reference. Disadvantageously, due to the difficulty in recording the phase pattern at microwave frequencies, these antennas were all of the amplitude type and consequently suffered from low aperture efficiencies, similar to Fresnel zone plate lenses disclosed by A. Petosa et al. in an article entitled "Comparison of an Elementary Hologram and Fresnel Zone Plate," *The Radio Science Bulletin*, no. 324, pp. 29-36, March 2008, which is incorporated herein by reference.

An ideal electromagnetic lens device would work in transmission, have minimal reflection and transmission losses, operate over a wide bandwidth, have a thin flat profile, be lightweight and inexpensive to manufacture. The prior art is lacking a transmission antenna device that would have a relatively high efficiency, while being inexpensive, lightweight, and thin.

The present invention provides a transmissive phase element that is electrically thin, inexpensive, and lightweight, while being capable of introducing a predetermined arbitrary phase shift pattern into an electromagnetic wave for focusing, collimating, redirecting, or splitting the electromagnetic wave in almost arbitrary manner. This versatile performance is achieved without introducing an excessive loss in the path of the electromagnetic wave. Furthermore, a phase element of the present invention can also introduce a predetermined arbitrary amplitude shift pattern in addition to the phase shift pattern. The amplitude shifting property can be used, for example, for electromagnetic beam shaping and pattern synthesis.

SUMMARY OF THE INVENTION

A phase element of the present invention generates a pattern of phase shifts using an approach similar to newspaper printing, where the grey tones are obtained from different size of small black dots in a given, predetermined array. Instead of the ink on paper used in the newspaper printing process, metallic patches are etched on a dielectric substrate layer. A single layer of metallic patches does not produce a significant phase shift range and is always associated with a considerable amplitude shift pattern dependent on the phase shift pattern. Accordingly, adding more thin dielectric layers has been initially expected to result in a corresponding increase of the transmission loss, which was undesired. Quite unexpectedly, however, adding more layers under certain conditions resulted in a significant decoupling of achievable phase and amplitude shift patterns. The decoupling allowed one to obtain a very low amplitude shift, or transmission loss, of the phase element. This allowed the inventors to produce low-loss, thin, and lightweight phase elements using a low-cost, mature and efficient process of metal etching on a dielectric substrate.

In accordance with the invention there is provided a phase element for introducing a predetermined phase shift pattern into an electromagnetic wave propagating therethrough, the phase element comprising stack of alternating conductive and dielectric layers each having a thickness, wherein the conductive layers are patterned throughout the thickness thereof, the patterned conductive layers having a spatially varying feature, so as to obtain the predetermined phase shift pattern, wherein the thickness of each of the dielectric layers are smaller than one tenth of a wavelength of the electromagnetic wave, and wherein the total number of the layers in the stack, including the conductive and the dielectric layers, is more than two but less than nine.

The spatially varying feature can be a conductive strip of varying width, or a rectangle of varying size, or some other conductive shape having a spatially varying dimension, orientation, or position relative to other shapes.

In accordance with another aspect of the invention there is further provided a phase element for introducing a predetermined phase shift pattern into an electromagnetic wave propagating therethrough, the phase element comprising stack of alternating conductive and dielectric layers each having a thickness, the stack including first and second neighboring conductive layers, wherein the first and the second conductive layers are patterned throughout the thickness thereof, so as to form a plurality of conductive shapes capacitively coupled to their respective neighboring shapes disposed in the same conductive layer, thereby forming two-dimensional patterns of first and second capacitances, respectively, and wherein the conductive shapes of the first conductive layer are capacitively and inductively coupled to their respective neighboring conductive shapes disposed in the second conductive layer of the stack, whereby the conductive shapes of the first and the second conductive layers form a two-dimensional pattern of transmission lines going through the stack, wherein each transmission line comprises a succession of a first capacitance of the two-dimensional pattern of first capacitances, capacitively and inductively coupled to a second capacitance of the two-dimensional pattern of second capacitances, wherein the first and the second capacitances are selected so as to introduce the predetermined phase shift pattern into the electromagnetic wave propagating through the phase element.

The phase element of the invention can be used in a low-profile antenna or in an antenna that is hidden from view.

In accordance with the invention there is further provided a method of manufacture of the phase element, comprising:

(a) selecting a material and a thickness for each of the layers of the stack;

(b) selecting the number of the conductive layers in the stack;

(c) performing an electromagnetic simulation of the stack to obtain a dependence of a phase shift value on the spatially varying feature; and (d) patterning the conductive layers to obtain the predetermined phase shift pattern, based on the dependence obtained in step (c).

In accordance with the invention there is further provided a method of manufacture of the phase element, comprising:

(a) selecting a material and a thickness for each of the layers of the stack;

(b) selecting the total number of the conductive layers in the stack;

(c) performing an electromagnetic simulation of the conductive shapes of the first and the second conductive layers, so as to obtain a dependence of a phase shift magnitude on dimensions and a relative position of the conductive shapes;

(d) based on the dependence obtained in step (c), determining the dimensions and the relative position of the conductive shapes of the first and the second conductive layers, required to obtain the pre-determined phase shift pattern; and (e) patterning the first and the second conductive layers to obtain the predetermined phase shift pattern, based on the dimensions and the relative position of the conductive shapes, obtained in step (d).

The patterning of the conducting layers of the phase element is preferably performed by etching through the conductive layers.

BRIEF DESCRIPTION OF THE DRAWINGS

Exemplary embodiments will now be described in conjunction with the drawings in which.

DETAILED DESCRIPTION OF THE INVENTION

While the present teachings are described in conjunction with various embodiments and examples, it is not intended that the present teachings be limited to such embodiments. On the contrary, the present teachings encompass various alternatives, modifications and equivalents, as will be appreciated by those of skill in the art.

Throughout the specification, the phase element of the invention is called a "phase and amplitude shifting surface" (PASS) or a "phase shifting surface" (PSS). Herein, the word "surface" is used to refer to an "electrically thin" element, that is an element whose lateral dimensions are much smaller than a wavelength of the electromagnetic wave propagating through the element. The PSS is an element that alters phase distribution of the electromagnetic wave, while introducing a negligible transmission loss.

Figure 1A:
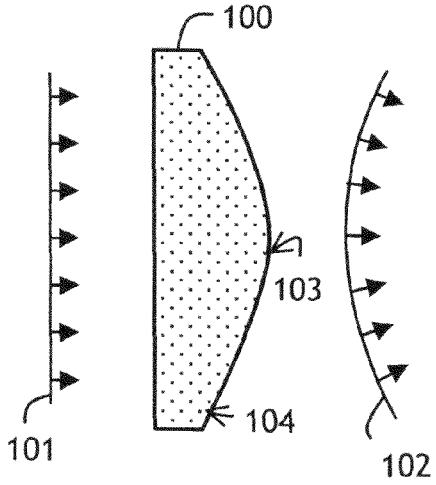
FIG. 1A Prior Art
FIGS. 1A, 1B, and 1C are schematic side views of prior-art lens, Fresnel zone plate, and microstrip patch antenna devices, respectively.
Figure 1B:
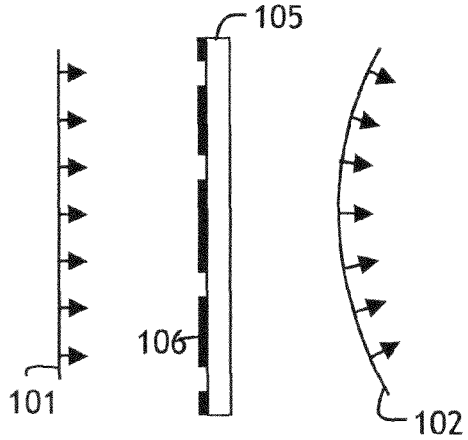
FIG. 1B Prior Art
Figure 1C:
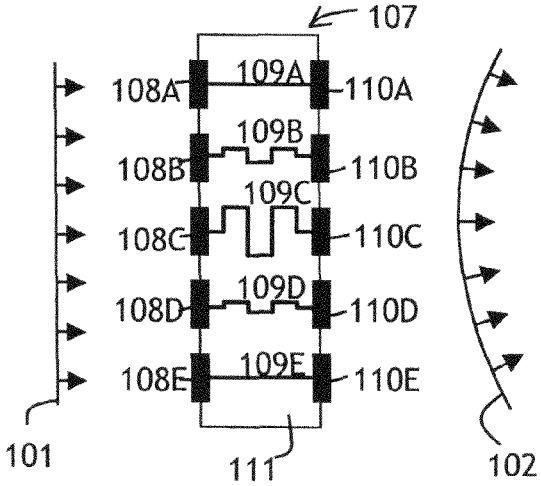
FIG. 1C Prior Art
Figures 2A, 2B, 2C:
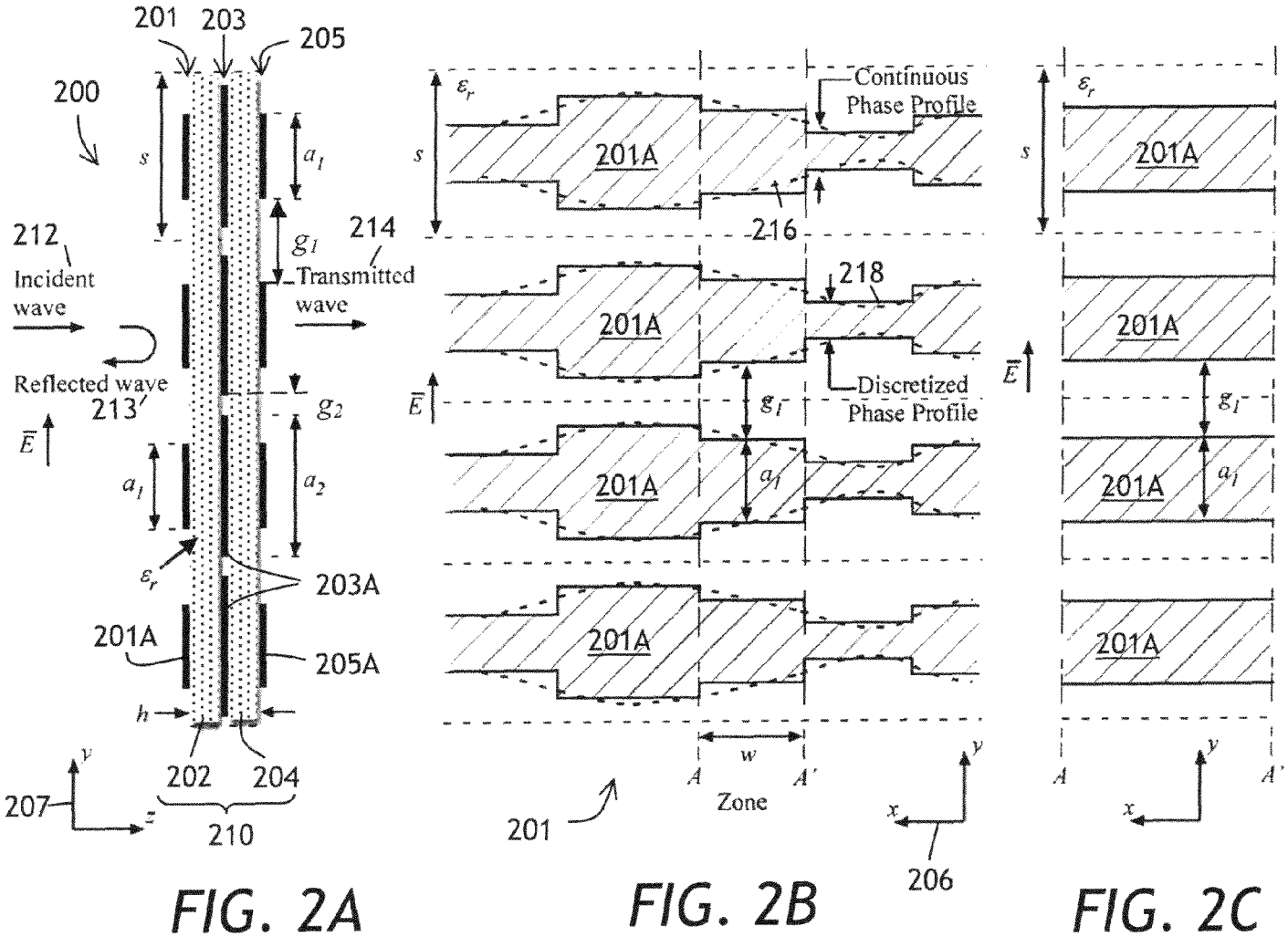
FIG. 2A is a cross-sectional side view of a phase element of the present invention.
FIG. 2B is a plan view of the upper surface of the phase element of FIG. 2A.
FIG. 2C is a magnified view of a portion of the upper surface of FIG. 2B, disposed between vertical dashed lines A and A' therein.

Referring to FIGS. 2A to 2C, a PSS, or a phase element 200 (FIG. 2A) of the invention is shown in side and plan views. In FIG. 2A, a side cross-sectional view of the phase element 200 of the present invention is shown. The phase element 200 has a stack 210 of alternating conductive layers 201, 203, and 205 and dielectric layers 202 and 204 having a dielectric constant $\in_r$. The symbol $\in_r$ denotes dielectric constant in FIGS. 2A, 2B, 2C, and 10A. The conductive layers 201, 203, and 205 are patterned, for example etched, on individual surfaces of the dielectric layers 202 and 204, forming conductive features 201A, 203A, and 205A, respectively, on individual surfaces of the dielectric layers 202 and 204. The conductive features 201A, 203A, and 205A are strips having spatially varying width. The width of the strips 201A and 205A is denoted as $a_1$, and the width of the strip 203A is denoted as $a_2$. The gap between neighboring strips 201A, or between neighboring strips 205A, is denoted as $g_1$. The gap between neighboring strips 203A is denoted as $g_2$. By spatially varying $a_1$ and/or $g_1$ and/or $a_2$ and/or $g_2$, the phase element 200 can be made to introduce a predetermined phase shift pattern into an incoming or incident electromagnetic wave 212.

Referring to FIG. 2B with further reference to FIG. 2A, a frontal view of the conductive layer 201 is presented. The strips 201A are represented by dashed areas. The strips 201A (FIGS. 2A and 2B), 203A (FIG. 2A), and 205A (FIG. 2A) extend perpendicular to FIG. 2A and along an X-axis 206 shown as a horizontal arrow in FIG. 2B. The width $a_1$ of the strips 201A (FIGS. 2A and 2B) and 205A (FIG. 2A), shown as dashed areas in FIG. 2B, varies along the X-axis 206, as shown in solid lines outlining the dashed areas. The width $a_2$ (FIG. 2A) of the strips 203A can also vary along the X-axis 206, or it can stay constant, depending on a particular phase shift pattern required. The strips 203A and 205A are not shown in FIG. 2B, for clarity of the picture. The widths $a_1$ and $a_2$ of the conductive strips 201A, 203A, and 205A and the thicknesses of the dielectric layers 202 and 204 are smaller than one half of a wavelength of the incident electromagnetic wave 212, as shown in FIG. 2A. Although having only two conductive layers 201 and 203 separated by one dielectric layer 202 are sufficient to construct a phase element of the present invention, a better performance is achieved with three conductive layers 201, 203, and 205, and two dielectric layers 202 and 204 therebetween (FIG. 2A).

In operation, as shown in FIG. 2A, the incident electromagnetic wave 212 polarized along a Y-axis 207, as indicated by the electric field vector E parallel to the Y-axis 207 (FIGS. 2A, 2B, and 2C), impinges on the front conductive layer 201 of the stack 210 inducing electric currents in the conductive strips 201A, 203A, and 205A. The conductive strips 201A, 203A, and 205A are electrically coupled to each other, the magnitude of electric coupling between the neighboring conductive strips 201A being dependent on the value of the gap $g_1$ at a constant cell height s (FIGS. 2A, 2B, and 2C). In the stack 210, the conductive strips 205A have the same shape as the conductive strips 201A, although in general it is not required, i.e. the conductive layers 201 and 205 can have different dimensions of the corresponding features, for example, different strip widths.

The electric coupling and associated gap $g_1$ variation along the X axis 206 (FIG. 2B) and the Y axis 207 are selected so as to cause a predetermined X, Y pattern of phase shift of a transmitted electromagnetic wave 214 as compared to the incoming electromagnetic wave 212. Intuitively, one could expect that a continuous phase variation would require a continuous, smooth variation of the gap $g_1$ shown at 216 (FIG. 2B; "Continuous Phase Profile"). In practice, however, the continuous gap variation 216 can be replaced with a "digitized" gap variation 218 (FIG. 2B; "Discretized Phase Profile"), wherein the gap width $g_1$ stays constant across a single "zone" A-A' having a width w, as shown in FIG. 2B. The phase shift quantization error becomes negligible when the width w is sufficiently small, for example smaller than one half of the wavelength of the electromagnetic wave 212, and preferably smaller than one tenth of the wavelength. Referring to FIG. 2C, a single "zone" A-A' of the conductive strip 201A having the width w along the X-axis 206 and a height s along the Y-axis 207 is shown. Across the zone A-A', the strip width $a_1$ and the gap width $g_1$ do not change.

In general, a reflected electromagnetic wave 213 is also formed as shown in FIG. 2A. Its magnitude can be minimized upon proper impedance matching of the stack 210 to that of the environment (typically free space), thus improving the transmission loss performance of the phase element 200. The impedance matching can be achieved upon a proper selection of the widths $a_1$ of the conductive strips 201A and/or the gaps $g_1$ between the conductive strips 201A, the widths $a_2$ of the conductive strips 203A and/or the gaps $g_2$ between neighboring strips 203A, the thickness h (FIG. 2A), and the dielectric constant $\in_r$ (FIGS. 2B, 2C). Particular examples of phase elements (PSS and PASS) construction, including thicknesses of layers, dielectric constants, feature shapes and dimensions, as well as resulting achievable magnitude of phase shift and associated transmission loss, will be given below.

Electromagnetic simulations of single unit cells have been performed to determine the resulting amplitude and phase in transmission as a function of the strip widths $a_1$ and $a_2$ and the corresponding gaps $g_1$ and $g_2$. The electromagnetic finite-difference time-domain (FDTD) simulations were performed under an assumption of infinite periodicity along the X-axis 206 and the Y-axis 207 and a normal incidence of a plane electromagnetic wave. Other simulation methods can also be used to generate the results, including a finite element method (FEM) and a method of moments (MoM).

Figure 3A:
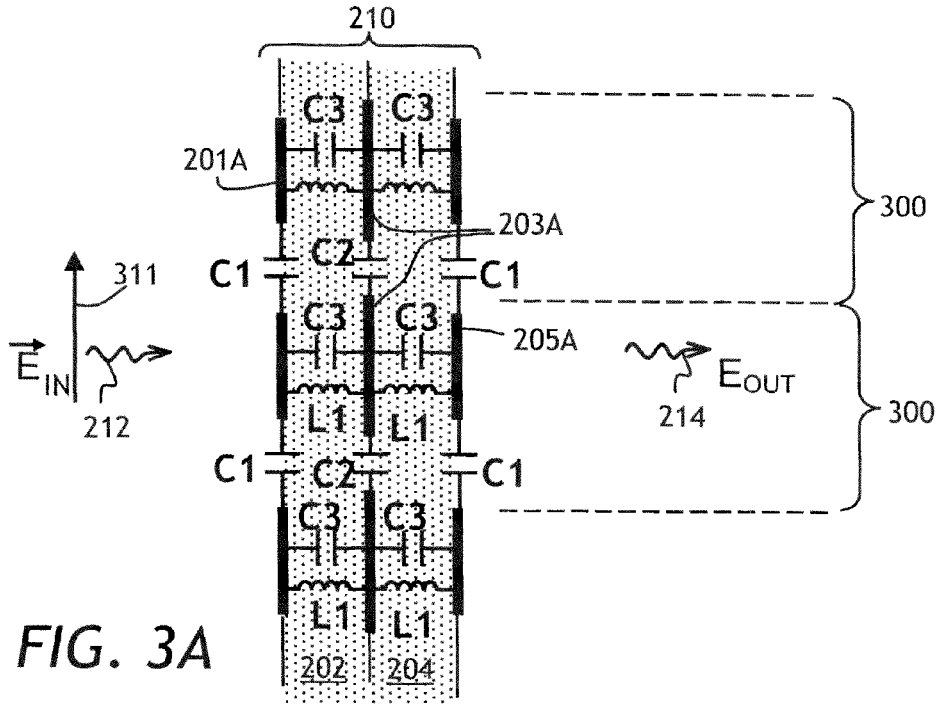
FIG. 3A is a cross-sectional side view of FIG. 2A having superimposed thereupon an equivalent electrical circuit.
Figure 3B:
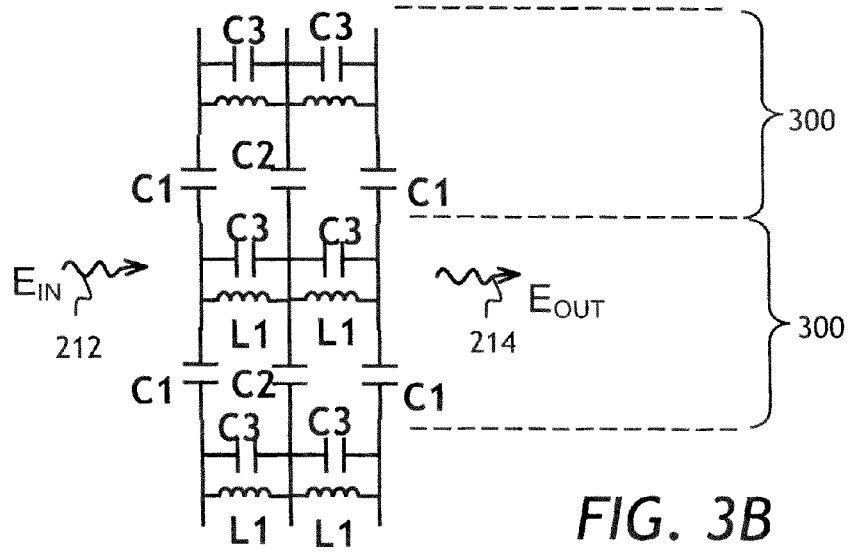
FIG. 3B is a schematic of the equivalent electrical circuit of FIG. 3A.

Turning now to FIG. 3A, an equivalent electrical circuit of the stack 210 of FIG. 2A is shown including dielectric layers 202, 204. The circuit has capacitances C1 between neighboring strips 201A, and also between the neighboring strips 205A which, as was noted above, repeat the shape of the strips 201A; capacitances C2 between the strips 203A; as well as capacitances C3 and inductances L1 between the respective neighboring conductive shapes disposed in neighboring conductive layers of the stack 210. Thus, the conductive layers 201, 203, and 205 form a two-dimensional pattern of transmission lines 300 going through the stack 210. Referring to FIG. 3B, the equivalent electrical circuit is redrawn for convenience, so that the transmission lines 300 can be better seen. Each transmission line 300 has a succession of the capacitances C1 capacitively and inductively coupled through the capacitance C3 and the inductance L1, respectively, to the capacitance C2 and to capacitance C1. The strip widths/gaps and the resulting capacitances are selected so as to introduce the predetermined phase shift pattern into the electromagnetic wave 212 (FIGS. 2A, 2B) propagating through the phase element to form the transmitted electromagnetic wave 214 (FIGS. 3A, 3B). The electromagnetic wave 212 is polarized orthogonally to the strips 201A, 203A, and 205A, as indicated with an arrow 311 (FIG. 3A).

Figure 3C:
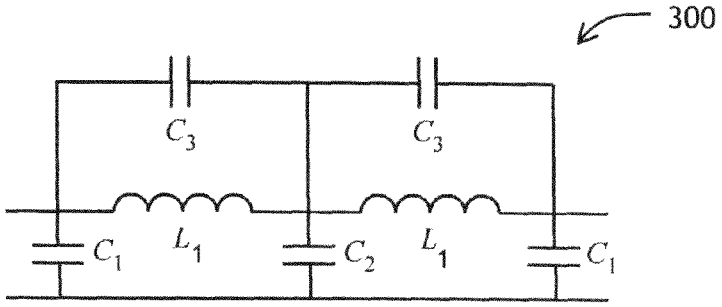
FIG. 3C is a schematic of a single transmission line of the circuit of FIG. 3B.

Referring to FIG. 3C, the transmission line 300 is redrawn for convenience. Amplitude and phase performance of the transmission line 300 can be calculated from the capacitances C1, C2, and C3 and the inductance L1 using analytical methods well known to those of skill in the art. Since the capacitances C1, C2, and C3 and the inductance L1 are determined by geometrical dimensions of the conductive strips 201A, 203A, and 205A, as well as thickness and dielectric constant $\in_r$ of the dielectric layers 202 and 204, one can establish a relationship between these parameters and the produced phase shift magnitude, for example in form of a database. From this database, the shape of the conductive strips 201A, 203A, and 205A and the gaps therebetween, required to obtain the pre-determined phase shift pattern, can be determined.

Figure 3D:
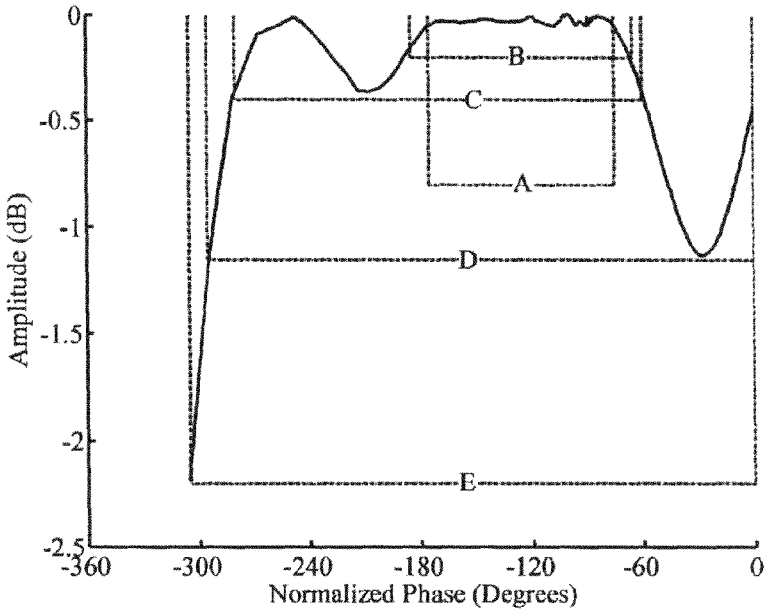
FIG. 3D is a graph showing a simulated best-case amplitude vs. phase performance of the phase element of FIGS. 2A to 2C.

Turning now to FIG. 3D, results of FDTD simulations of the phase element 200 are presented. The FDTD simulations were performed using Empire XCcel™ simulation software commercially available from IMST GmbH, Dusseldorf, Germany. The simulations were conducted over a frequency band including the frequency of 30 GHz, at cell width s (see FIG. 2B) of 3 mm, dielectric constant $\in_r$ of 2.2 and the total thickness h of 1 mm. The results are shown in form of a graph of a best-case transmission loss in dB units ("Amplitude (dB)") vs. achievable phase performance at 30 GHz in degrees ("Normalized Phase (Degrees)") assuming infinite periodicity of the strips 201A, 203A, and 205A and normal angle of incidence of the incident electromagnetic wave 212. The phase shift introduced by areas having with no strips, that is, areas having only the dielectric layers 202 and 204, is taken to be zero. Operating points close to the top-end of the vertical axis correspond to the case of 0 dB loss, or 100% transmission. Operating points away from this axis correspond to a reduced transmission coefficient, which translates into a lower efficiency of the phase element 200. FIG. 3D shows the best transmission cases for different phase values. Inspection of FIG. 3D allows one to determine the transmission amplitude variation obtainable for a given range of transmission phase values. In FIG. 3D, letters A, B, C, D, and E denote ranges of phase variation obtainable at different values of maximum allowable transmission loss. These ranges and values are summarized in the following Table 1.

TABLE 1

| Region | Transmission Loss, dB | Phase Shift Range, degrees |
|---|---|---|
| A | 0 | 100 |
| B | 0.2 | 120 |
| C | 0.4 | 220 |
| D | 1.15 | 295 |
| E | 2.2 | 305 |

The results of simulation presented in FIG. 3D and Table 1 prove that the phase element 200, having total of 5 layers in the stack 210, including three conductive layers 201, 203, and 205, can provide a wide range of achievable phase shift at moderate transmission loss penalties. By way of example, with three patterned conductive layers 301, 303, and 305, the practically achievable phase shift range is from 0 degrees to 300 degrees of phase and the transmission loss is less than 2.5 dB.

With four different patterned conductive layers, the achievable phase shift range can vary from zero degrees to slightly beyond 360 degrees of phase and the transmission loss is less than 2 dB, as the following Table 2 indicates.

TABLE 2

| Transmission Loss, dB | Minimum Phase Shift, degrees | Maximum Phase Shift, degrees | Phase Shift Range, degrees |
|---|---|---|---|
| 0 | −50 | −300 | 250 |
| 0.2 | −40 | −325 | 285 |

TABLE 2-continued

| Transmission Loss, dB | Minimum Phase Shift, degrees | Maximum Phase Shift, degrees | Phase Shift Range, degrees |
|---|---|---|---|
| 0.7 | 0 | −335 | 335 |
| 1.7 | 0 | −360 | 360 |

The relative permittivity $\in_r$ of the dielectric layers 202 and 204 is preferably selected to be low, for example between 2 and 3; a value of 2.2 was used by the inventors for prototyping. The thickness h is to be kept relatively small, typically 1-1.5 mm at 30 GHz (Ka band), which corresponds to 0.1-0.15 of the free-space wavelength of the incoming electromagnetic wave 212. In one embodiment, the thickness h is less than one third of the wavelength. The thickness of individual dielectric layers 202 and 204 is preferably less than one tenth of the wavelength. This combination of the dielectric constant $\in_r$ and thickness h in the given range allows for achieving a large phase shift range with relatively high amplitude transmission. If high electromagnetic transparency is required, the phase element 200 can be designed to minimize the reflection and maximize the transmission of the incident wave 212.

The phase element 200 is simple to fabricate using conventional etching processes resulting a thin, low-cost and lightweight antenna. When used as a lens, the phase element 200 offers similar performance to a dielectric piano-hyperbolic lens antenna over a reasonable bandwidth. When optimized for other applications, including amplitude control, the phase element 200 allows independent phase and amplitude shifting. The inventors discovered that, due to the inductive and capacitive coupling between the conductive layers 201, 203, and 205, a large phase shift, of the order of 300 degrees of phase, can be achieved; furthermore, quite remarkably, this large phase shift can be achieved at a low transmission loss of less than 2.5 dB. Furthermore, with four conductive layers, the phase shift range of 360 degrees is achievable at a transmission loss of below 2 dB.

Even with two electrically coupled conductive layers, the transmission loss of a PSS or a PASS element can be lessened, the phase shifting range of 120 degrees still being achievable. The electrical coupling between the neighboring conductive layers is characterized by the interlayer capacitance C3. For the reduction of the transmission loss, it is preferable that C3 be equal to or greater than 20% of C1 or C2, whichever is less. This is only possible when the thickness of the dielectric layer is small, typically less than a tenth of a free-space wavelength. In general, for multi-layer phase elements of the invention, it is preferable that the interlayer capacitance is equal to or greater than 20% of the capacitance between adjacent spatially varying features of the same patterned conductive layer.

Conventional photolithographic process has a limited achievable smallest gap size, thereby limiting a range of the capacitances C1 and C2 that are achievable in practice. If the unit cell height s (defined in FIG. 2B) is too small, the capacitances C1 and C2 will be very low and no practical phase shift range could be achieved. However, for the same gap size, C1 and C2 can be increased if the unit cell size is increased. A smaller unit cell size allows for a smaller quantization error, but it may lead to a smaller phase shift range, depending on the achievable gap size. Consequently, it may be preferred to increase the unit cell size, despite an increase of the quantization error. In the prototypes designed at 30 GHz, the unit cell size is 3 mm, or about one third of the wavelength.

Figure 4:
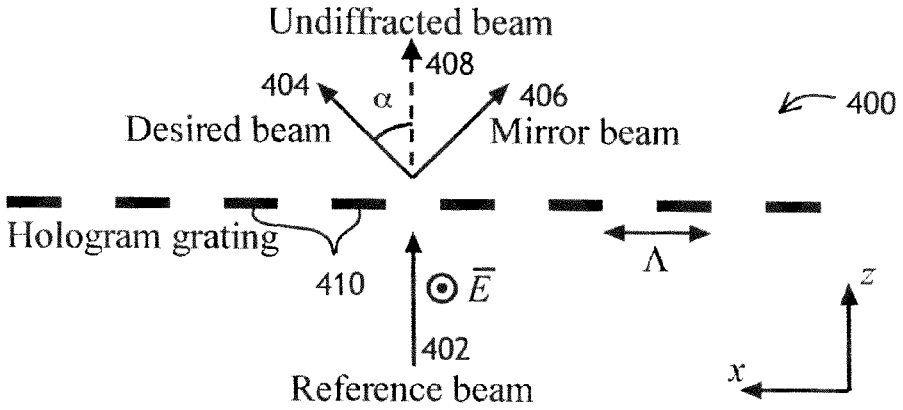
FIG. 4 is a schematic side view of a microwave diffraction grating of the invention.

To verify the performance of a phase element of the present invention, a number of prototypes of PSS and PASS elements were constructed and tested. One of the simplest phase elements is a phase diffraction grating. Referring to FIG. 4, a schematic side view of a phase diffraction grating 400 is shown. The phase diffraction grating 400 has parallel lines 410 introducing a periodic non-zero phase delay P into a wavefront of an incoming reference beam 402 having the electric field vector E directed as shown. The grating lines 410 are evenly spaced apart with a period Λ and extend in a direction perpendicular to the XZ plane (that is, in Y-direction going in and out of plane of FIG. 4). A phase delay introduced by the grating lines 410 is constant in going along the grating lines 410 (that is, along the Y-direction). The "reference-"beam 402 striking the grating 400 is diffracted on the hologram grating lines 410, splitting into a "desired" beam 404 and a "mirror" beam 406, which "mirrors" the desired beam 404. A fraction of the reference beam 402 exits the diffraction grating 400 as an undiffracted, or zero-order beam 408. This terminology comes from holography, wherein a reference beam is made to interfere with a desired beam to record a hologram, which upon subsequent illumination with the reference beam recreates the desired beam through the phenomenon of diffraction. The angle α of the desired beam depends on the wavelength of the reference beam 402 and the grating period Λ, as is well known to those of skill in the art.

Figure 5:
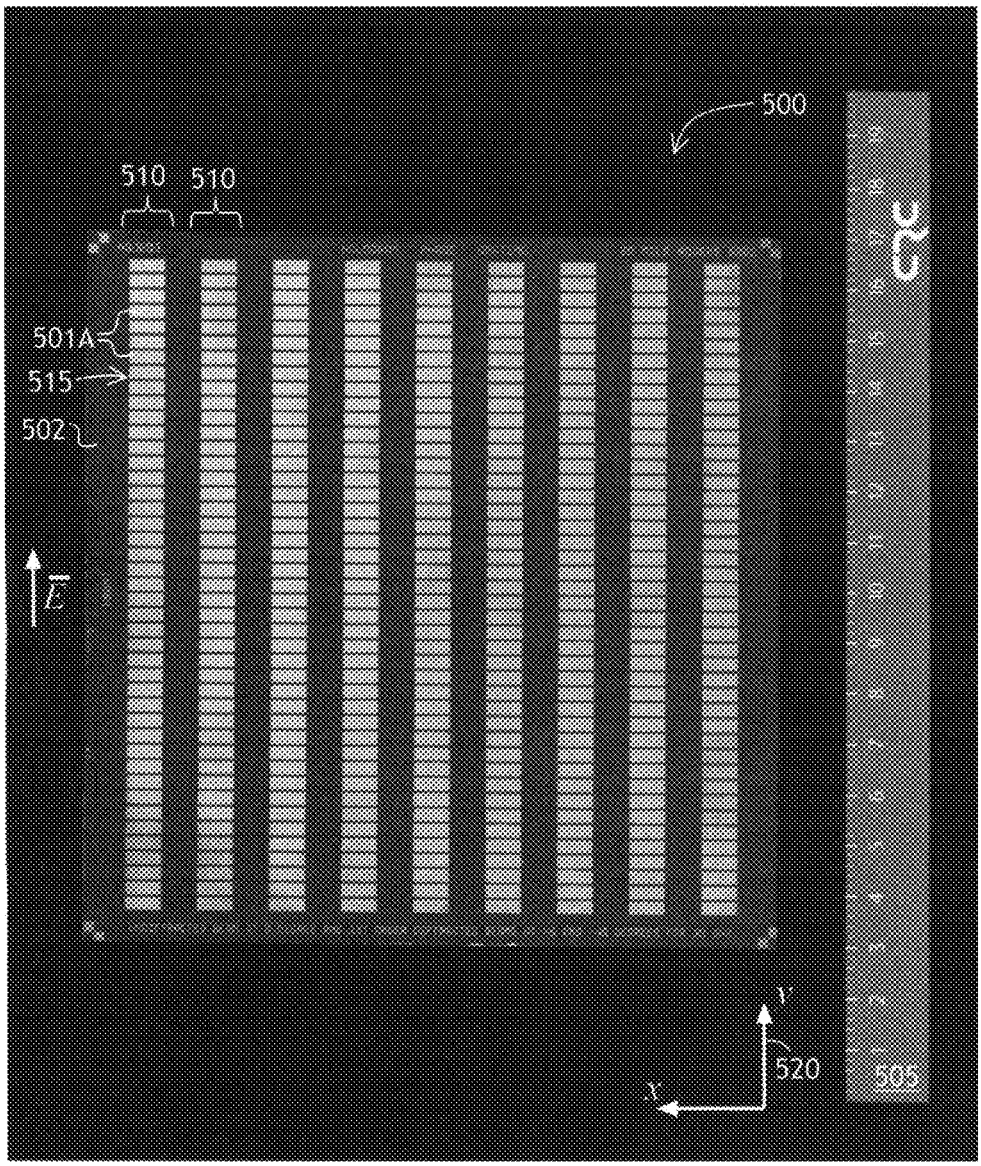
FIG. 5 is a photograph of a prototype of the diffraction grating of FIG. 4.

Turning now to FIG. 5, a photograph of a prototype 500 of the diffraction grating 400 is shown in a plan view. The prototype 500 has the general structure of the phase element 200 of FIGS. 2A to 2C, consisting of three conductive layers and two dielectric layers therebetween. The difference between the prototype 500 and the phase element 200 is that the conductive features 501A have a fixed width, to have a fixed phase delay along grating lines 510. The array of the conductive features 501A and the array of the conductive features underlying the features 501A together form the grating lines 510. The grating lines 510 are spaced apart along the X-axis and run parallel to an Y axis 520. The grating lines 510 correspond to the grating lines 410 of the diffraction grating 400. A ruler 505 is shown in FIG. 5 next to the diffraction grating 500 to show the scale of the diffraction grating 500. The ruler 505 shows length in centimeters.

The phase delay introduced by the grating lines 410 depends on a gap 515 between neighboring conductive features 501A, as well as a gap between the conductive features underlying the features 501A. The gaps between the conductive features in the prototype grating 500 and the thicknesses and the dielectric constants of the dielectric layers were selected so as to minimize the transmission loss. The dielectric constant $\in_r$ of the dielectric layers 502 was 2.2, and the total thickness h was about 1 mm.

The following Table 3 shows the ideal and the simulated transmitted phase shift values, as well as associated strip width parameters $a_1$ and $a_2$.

TABLE 3

| Region | Ideal Transmitted Phase, degrees | Ideal Transmitted Amplitude, dB | Simulated Transmitted Phase, degrees | Simulated Transmitted Amplitude, dB | $a_1$ | $a_2$ |
|---|---|---|---|---|---|---|
| no strips | 0 | 0 | 0 | −0.437 | 0 | 0 |
| strips 510 | −180 | 0 | −178.2 | −0.073 | 2.55 | 2.85 |

Figure 6:
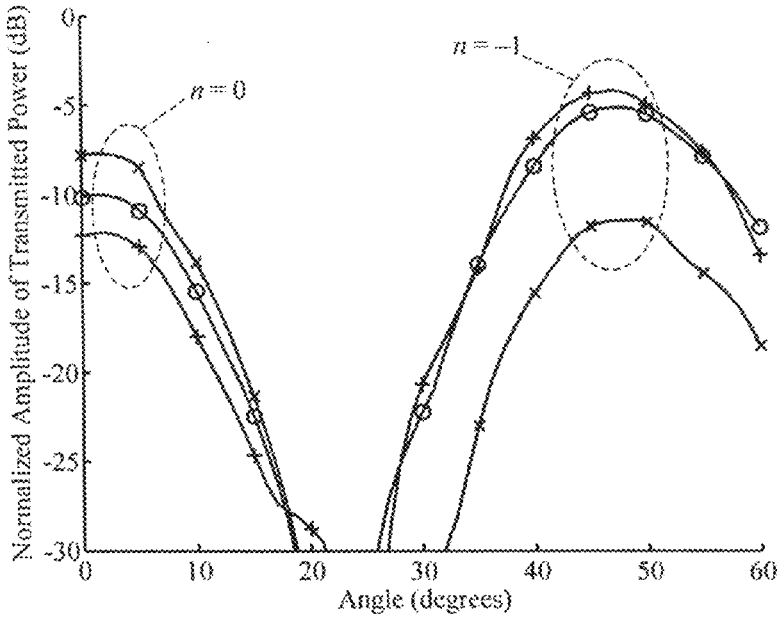
FIG. 6 is an angular dependence of electromagnetic power transmitted through the prototype diffraction grating of FIG. 5.

Referring now to FIG. 6 with further reference to FIG. 4 and FIG. 5, results of testing of the prototype 500 are presented. In FIG. 6, transmitted power at the frequency of 30 GHz ("Normalized Amplitude of Transmitted Power (dB)") is plotted in dB units as a function of receiver angle in degrees ("Angle (degrees)") for three types of diffraction gratings: the prototype 500 (shown in "+" signs), a dielectric phase grating (shown in circles), and an amplitude grating (shown in "X" signs). The diffracted beam 404 of FIG. 4 is denoted in FIG. 6 as "n=−1". The undiffracted beam 408 of FIG. 4 is denoted in FIG. 6 as "n=0". The incoming electric field E is shown in FIG. 5 as parallel to the grating lines 510 and the Y-axis 520. The transmitted power is normalized by the power of the reference beam 402 of FIG. 4. It is seen that the prototype 500 of FIG. 5 outperforms the dielectric grating at the angle α≈47 degrees of the first-order diffracted "desired beam" 404 of FIG. 4. In fact, the fraction of power of the first-order diffracted beam 404 approaches a maximum attainable power to within 2% (39% for the prototype 500 compared to 41% for the maximum attainable power), which proves that a phase element of the invention is indeed capable of achieving very high efficiency and low transmission loss.

Figure 7:
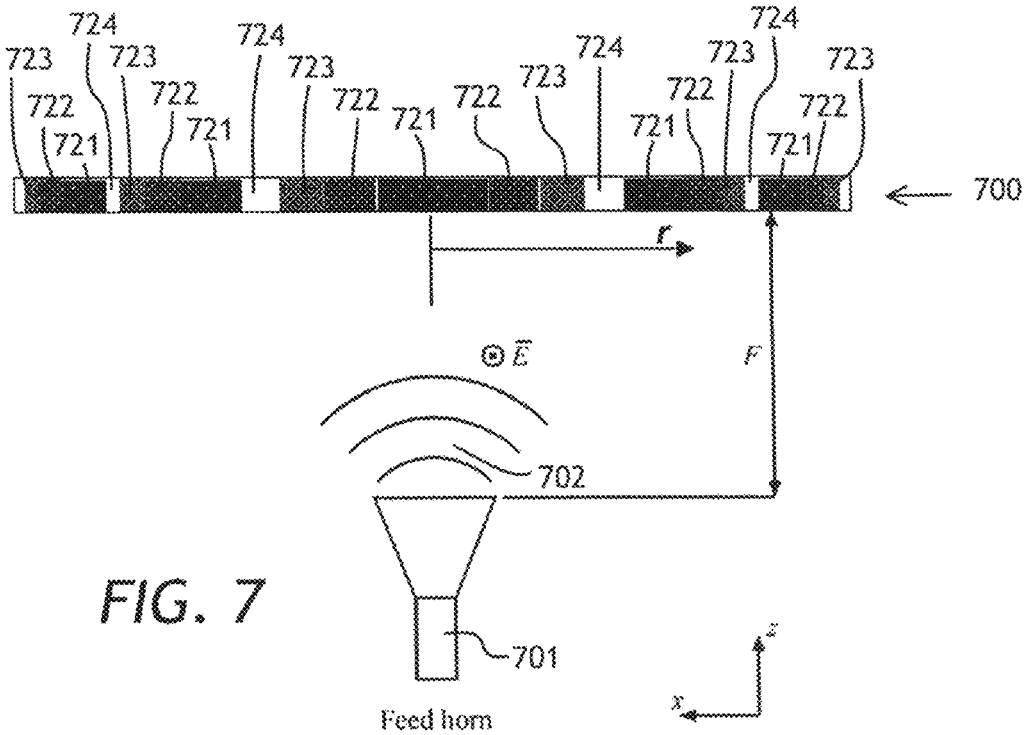
FIG. 7 is a schematic side view of a microwave cylindrical lens of the invention.

A cylindrical phase correcting Fresnel zone plate lens antenna, hereafter called a "cylindrical lens", has also been built according to the invention. Referring now to FIG. 7, a schematic side view of a "cylindrical lens" 700 is shown. The "cylindrical lens" 700 is in fact a phase element (a PSS) of the invention, introducing into an incoming electromagnetic wave a pattern of phase shifts that is similar to one introduced by a dielectric lens of a cylindrical shape having a 90 degree step phase correcting pattern. Herein, it is called a "cylindrical lens" 700 for brevity. The cylindrical lens 700 has parallel bars 721, 722, 723, and 724 introducing phase delays $P_1$ to $P_4$, respectively, into a wavefront of an incoming reference beam 702 at a frequency of 30 GHz, emitted by a feed horn 701 disposed one focal length F away from the cylindrical lens 700 and polarized as shown by the electric field vector E. Similarly to the diffraction grating 400, the bars 721 to 724 run parallel to the Y-axis, that is, in and out of the plane of FIG. 7. The effect of the cylindrical lens 700 is to collimate the beam 702 in the XZ plane. The phase delays $P_1$ to $P_4$ are equal to −270 degrees; −180 degrees; −90 degrees; and 0 degrees, respectively. The widths of the bars 721 to 724 are determined using Fresnel "zoning rule" for flat surfaces in geometric approximation given by $$r_i = \sqrt{\frac{2iF\lambda_0}{P} + \left(\frac{i\lambda_0}{P}\right)^2},\ i = 1, 2, \ldots, N \tag{1}$$

wherein $r_i$ is the size of the i-th Fresnel zone along the axis r, F is the focal length, $\lambda_0$ is the free-space wavelength, P is the number of corrections, and N is the total number of zones. In the cylindrical lens 700, P=4 and F=76.2 mm. The following Table 4 summarizes the ideal and the simulated transmitted phase shift values, as well as associated width parameters $a_1$ and $a_2$ of the bars 721 to 724. The cell height s (see FIG. 2B) is 3.00 mm.

TABLE 4

| Bar numeral | Ideal Transmitted Phase Delay, degrees | Ideal Transmitted Amplitude, dB | Simulated Transmitted Phase Delay, degrees | Simulated Transmitted Amplitude, dB | $a_1$ | $a_2$ |
|---|---|---|---|---|---|---|
| 724 | 0 | 0 | 0 | −0.437 | 0 | 0 |
| 723 | −90 | 0 | −89.3 | 0 | 2.32 | 2.00 |
| 722 | −180 | 0 | −175.6 | −0.049 | 2.54 | 2.85 |
| 721 | −270 | 0 | −264.8 | −0.098 | 2.83 | 2.83 |

Figure 8:
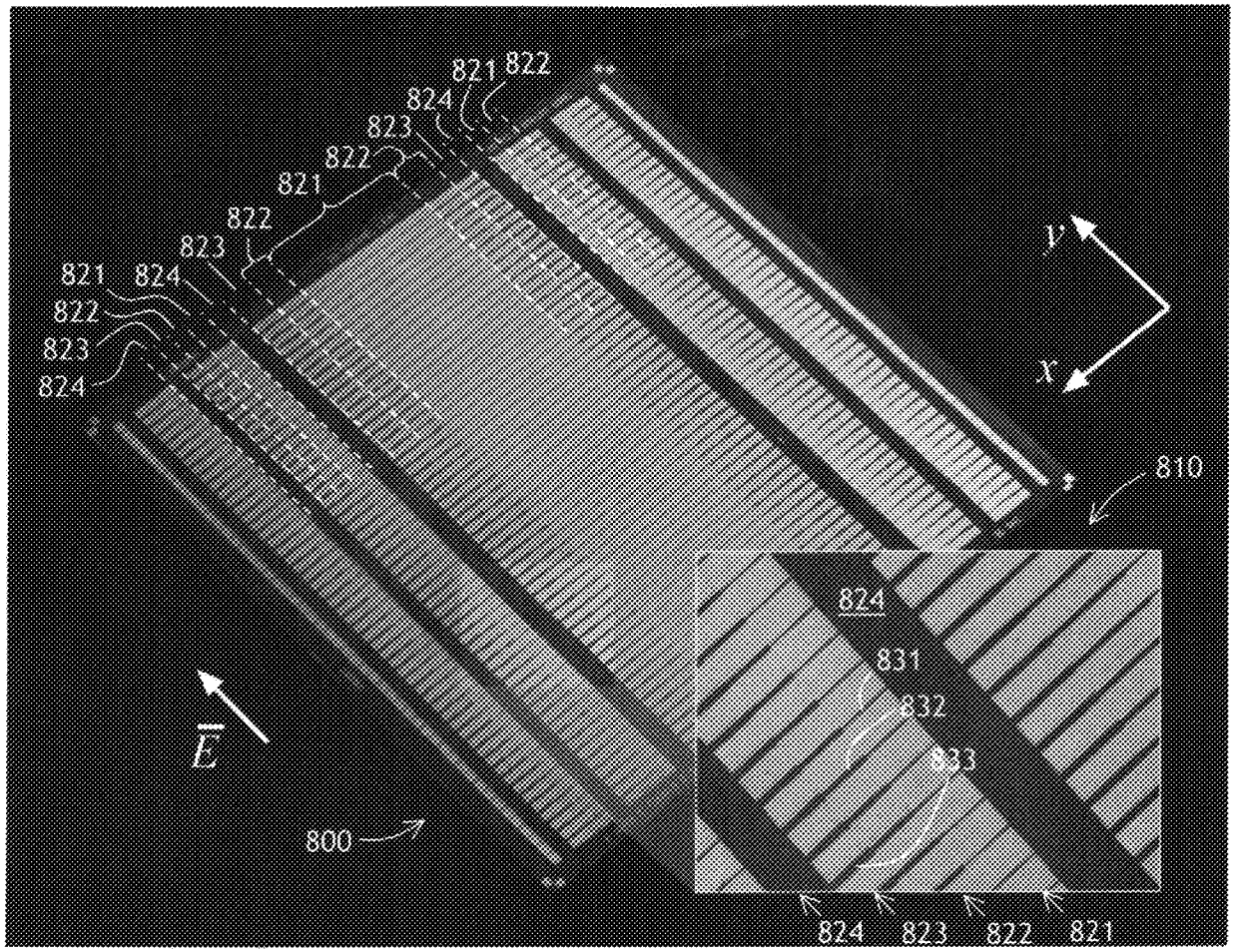
FIG. 8 is a photograph of a prototype of the cylindrical lens of FIG. 7.

Turning to FIG. 8, a photograph of a prototype 800 of the cylindrical lens 700 is shown in a perspective view. The prototype 800 has the general structure of the phase element 200 of FIGS. 2A to 2C, consisting of three patterned conductive layers and two dielectric layers therebetween. Parallel bars 821, 822, 823, and 824 of the prototype 800 correspond to the parallel bars 721 to 724 of the cylindrical lens 700 of FIG. 7, and the nominal widths $a_1$ and $a_2$ of the conductive strips of the parallel bars 821, 822, 823, and 824 are the same as the widths $a_1$ and $a_2$ of the conductive strips of the parallel bars 721 to 724 of FIG. 7, shown in the two rightmost columns in Table 4 above. As is evident from FIGS. 2B and 2C, the gap width $g_1$ is calculated as the difference between the cell width s and the parameter $a_1$; therefore, the smaller is the $a_1$ parameter, the larger is the gap $g_1$. An insert 810 shows the structure of the parallel bars 821, 822, 823, and 824 in more detail, the bars 821 to 823 differ by a size of respective gap 831, 832, and 833 between conductive (copper) features, the gap 831 being the smallest and the gap 833 being the largest, in accordance with the corresponding values $a_1$ of Table 4 for the bars 731 to 733.

Figure 9:
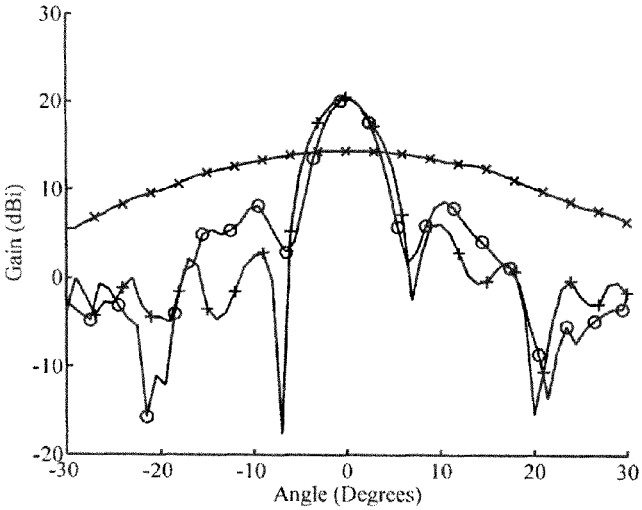
FIG. 9 is an angular dependence of gain of the prototype cylindrical lens of FIG. 8.

The far-field gain patterns of the cylindrical lens 800 were measured in an anechoic chamber. A traditional cylindrical dielectric Fresnel zone plate lens of the same exact size in the XY plane but with a thickness of 15 mm and made of Plexiglas™, or poly(methyl methacrylate) (PMMA) was used for comparison. Referring now to FIG. 9, a far-field radiation pattern with the cylindrical lens 800 in the beam path is presented, wherein the far-field gain of the cylindrical lens 800 is plotted in dBi units as a function of the measurement angle in degrees. The beam frequency was 29.5 GHz, and the beam polarization is shown by the electric vector E in FIG. 8. The "+" signs (FIG. 9) denote measurement points taken with the prototype cylindrical lens 800; the circles denote the measurements performed with the dielectric lens; and the "×" signs denote a reference measurement of the radiation emitted by the feed horn 701 (FIG. D, with the lenses removed from the beam path. One can see from FIG. 9 that the transmission loss and beam width performance of the prototype lens 800 matches closely that of the dielectric lens, the beam width being slightly larger than that of the dielectric lens, and the sidelobe performance of the prototype cylindrical lens 800 being better than that of the dielectric lens.

Figure 10A:
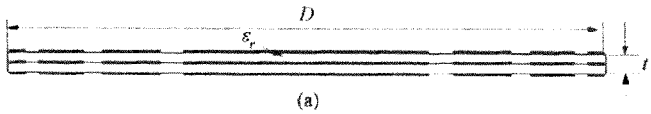
FIGS. 10A and 10B are side and front views, respectively, of a lens of the present invention for operating in a single polarization.
Figure 10B:
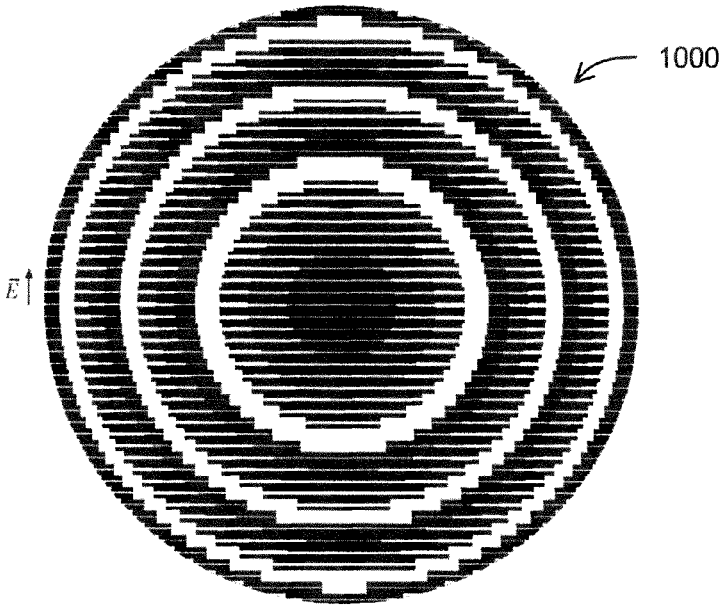
Figure 11A:
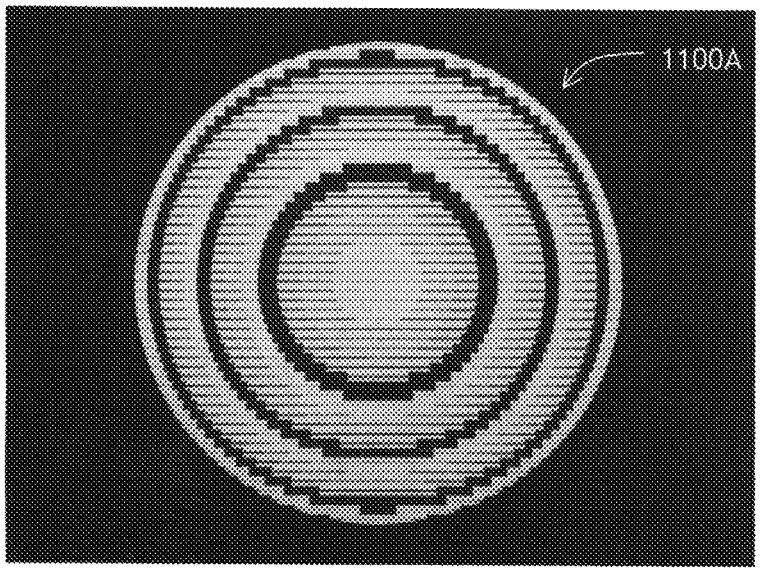
FIGS. 11A and 11B are photographs of two prototypes of the lens of FIGS. 10A and 10B.
Figure 11B:
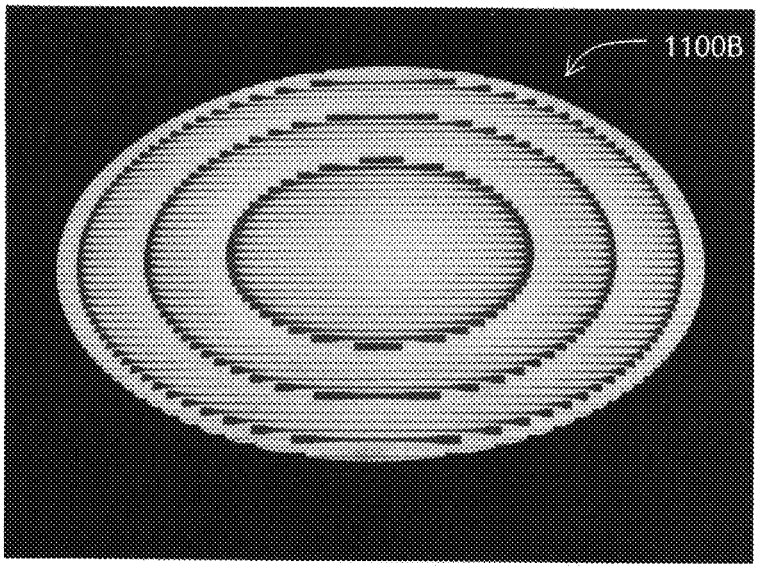

Flat lenses with 90 degree, 45 degree and continuous phase correction according to the present invention were fabricated and tested. Referring to FIGS. 10A and 10B, side and a plan views of a 90 degree phase-correcting flat lens 1000 (FIG. 10B) are shown, respectively. Referring to FIGS. 11A and 11B with further reference to FIGS. 10A and 10B, photographs of prototypes 1100A (FIG. 11A) and 1100B (FIG. 11B) of 90-degree and continuous phase-correcting lenses are presented, respectively. The prototype lenses 1100A and 1100B have a thickness t (FIG. 10A) of about 1.0 mm, which corresponds to 0.1 of a free-space wavelength at the frequency of 30 GHz, a diameter D (FIG. 10A) of 152.4 mm, and a focal distance F of 76.2 mm, which corresponds to the F/D ratio of 0.5.

Figure 12:
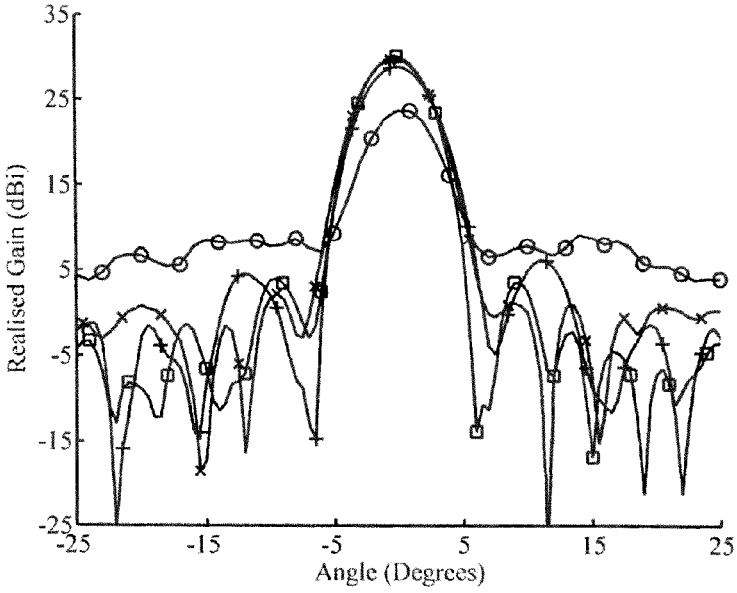
FIG. 12 is an angular dependence of gain of the prototype lens of FIG. 11A.
Figure 13:
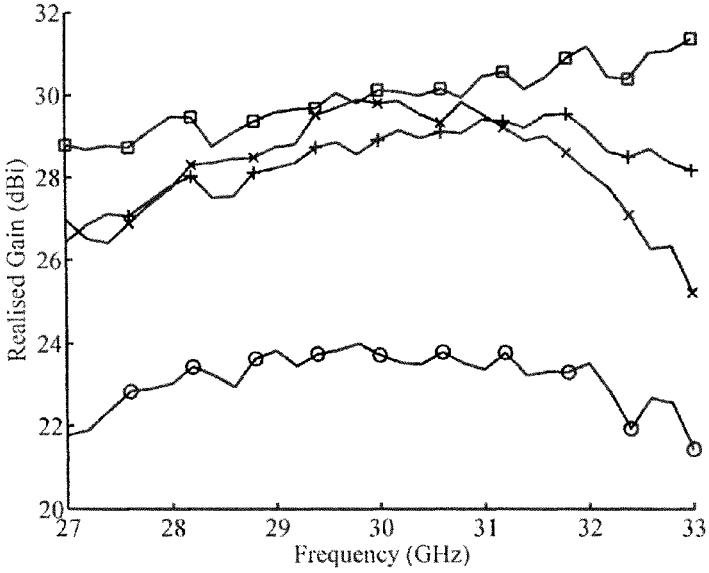
FIG. 13 is a frequency dependence of gain of the prototype lens of FIG. 11A.

Turning now to FIGS. 12 and 13, measured angular and frequency dependencies of gain obtained using the prototype lens 1100A are shown, respectively. In FIG. 12, the gain of the prototype lens 1100A is plotted in dBi units as a function of the measurement angle in degrees. In FIG. 13, the gain of the prototype lens 1100A is plotted in dBi units as a function of frequency in GHz. In FIGS. 12 and 13, the performance of the prototype lens 1100A is compared to the performance of a dielectric plano-hyperbolic lens, a 90 degree phase-correcting Fresnel zone plate, and a Fresnel zone plate. The squares (" ") correspond to the dielectric plano-hyperbolic lens; the crosses ("+") correspond to the phase-correcting Fresnel zone plate; the circles correspond to the Fresnel zone plate antenna; and the cross signs ("×") correspond to the prototype lens 1100A. One can see by comparing the far-field gain profiles obtained with these lenses that the prototype lens 1100A shows impressive results. Its boresight gain is only 0.3 dB less than the gain of the dielectric plano-hyperbolic lens at 30 GHz, with a weight reduction of almost ten times, a thickness reduction close to 40 times, and improved cross-polarization performance. The prototype lens 1100A outperforms the 90 degree phase-correcting Fresnel zone plate in almost every aspect with significant practical advantages; its boresight gain is almost 1 dB higher at 30 GHz, its weight is more than 5 times less and its thickness is reduced by a factor of almost 8. Therefore, the results presented in FIGS. 12 and 13 prove that a phase element of the present invention is a very viable and practical alternative for many applications.

The phase elements 200, 400, 500, 700, 800, 1000, 1100A, and 1100B are designed to operate in a single polarization perpendicular to the conductive stripes 201A, 203A, and 205A, as shown by the direction of the electric field vector E in FIGS. 2A-2C, 4, 5, 7, 8, and 10B. This provides an advantage of combining the phase element and a polarizer in a single element.

Figure 14:
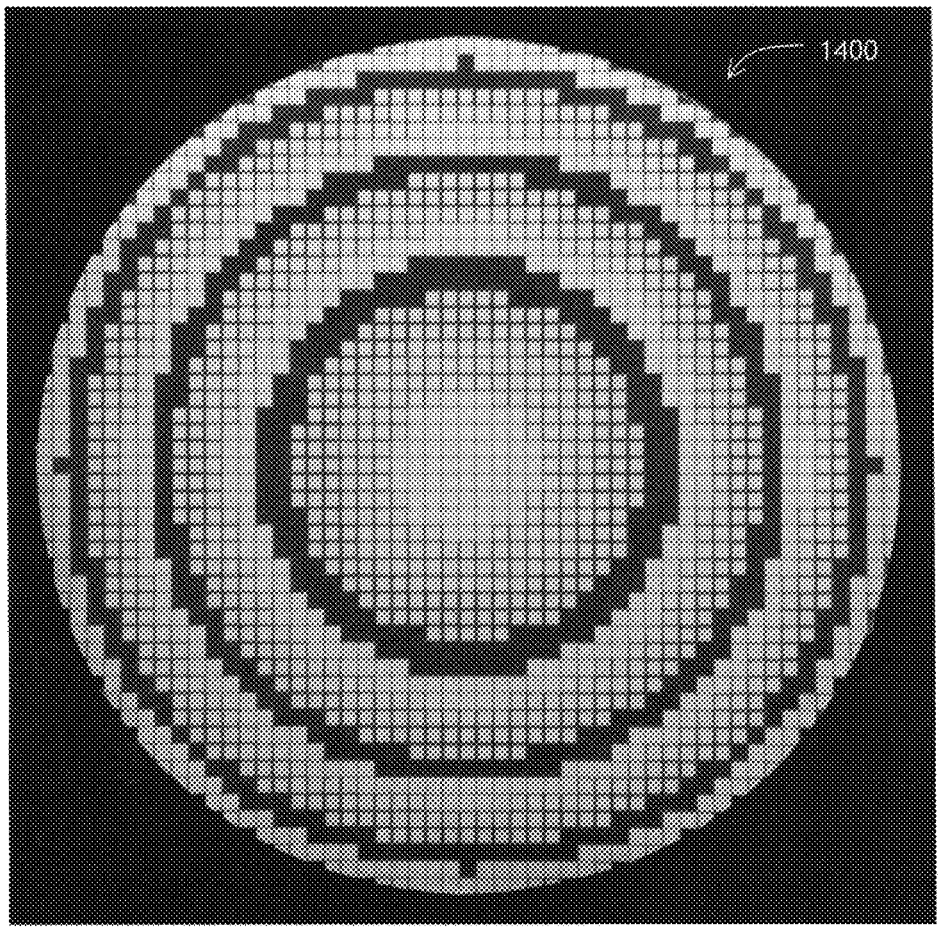
FIG. 14 is a photograph of a prototype of a polarization-independent lens of the present invention.

A phase element of the present invention can also be constructed to operate with an unpolarized or randomly polarized electromagnetic wave. Referring to FIG. 14, a photograph of a polarization-insensitive lens prototype 1400 is shown. The conductive layers of the lens 1400 are patterned with not stripes but squares, thus achieving polarization insensitivity. The lens 1400 has three metal layers etched on two thin dielectric sheets which are then bonded using a bonding film and pressed together. The substrates have a dielectric constant of 2.2 and thickness of approximately 0.05 free-space wavelength each. Thus the total thickness is about 0.1 free-space wavelength, which leads to a very thin, flat, light-weight and low-cost lens configuration. The unit cell size for the square elements is 3×3 mm. The diameter D of the lens is 152.4 mm and the focal distance F is 76.2 mm, yielding the F/D ratio of 0.5.

Figure 15:
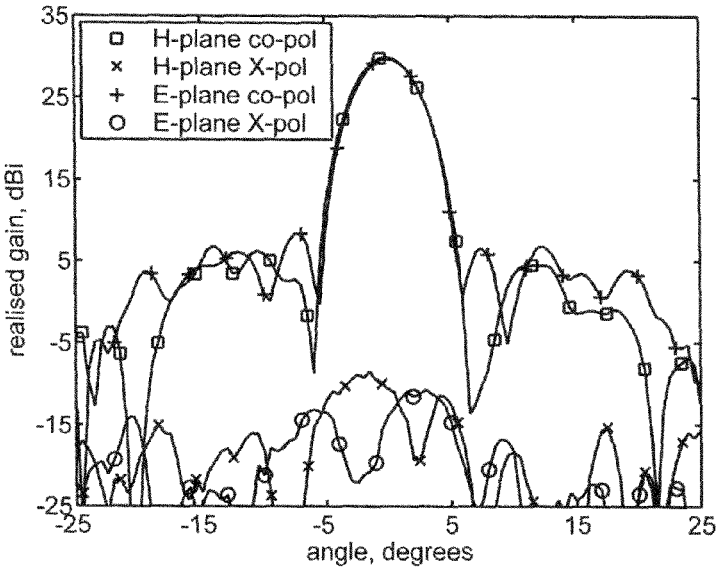
FIG. 15 is an angular dependence of gain of the prototype lens of FIG. 14.
Figure 16:
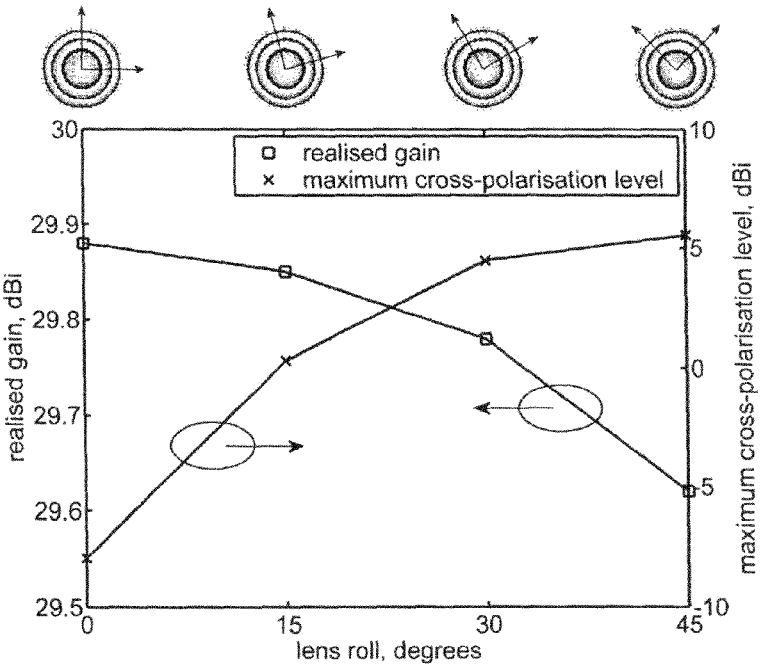
FIG. 16 is a dependence of gain of the lens of FIG. 15 on roll angle of the lens.

To verify the performance of the lens 1400, far-field radiation patterns of electromagnetic radiation at 30 GHz collimated with the lens 1400 were measured. Referring to FIGS. 15 and 16, the gain of the lens 1400 is plotted in dBi units as a function of the measurement angle in degrees in FIG. 15 and the lens "roll" angle in degrees in FIG. 16, for different polarization configurations. In FIG. 15, squares correspond to the H-plane co-polarized ("co-pol") measurements; "×" signs correspond to the H-plane cross-polarized ("X-pol") measurements; "+" signs correspond to the E-plane co-polarized ("co-pol") measurements; and circles correspond to the E-plane cross-polarized "X-pol") measurements. In FIG. 16, squares correspond to realized gain in dBi, and "×" signs correspond to maximum cross-polarization level in dBi. In FIG. 16, the roll angle values are illustrated by four images of the lens at the top of the graph.

The boresight gain measured is 29.9 dBi and the maximum cross-polarization level is −8 dBi at 30 GHz at a lens rotation, or "roll angle", of 0 degrees. A maximum realized gain of 30 dBi occurs at 29.9 GHz; by accounting for the return loss of 17.8 dB at that frequency, the corresponding aperture efficiency is calculated to be 44.6%. The realized gain results are marginally higher than that of the strip-based lens 1100A, whereas the cross-polarization performance is slightly degraded.

Referring again to FIG. 16, a measured dependence of gain and cross-polarization on the roll angle is presented. Small sketches on top of the plot are added to help visualize the rotation angle. FIG. 16 shows a marginal gain degradation of about 0.25 dB when the lens is rotated from 0 degrees to 45 degrees. The cross-polarization was found to increase by 13.5 dB as the lens 1400 was rotated from 0 degrees to 45 degrees, reaching a maximum value of 5.5 dBi. The cross-polar sidelobe level is still within an acceptable range for the worst-case at 45 degrees, with a value of −24 dB.

The inventors have determined that three conductive layers are sufficient in most cases to build a PSS, or a phase shifting element. If an independent phase and amplitude shifting (PASS) is required, then the number of conductive layers is preferably 4 or more. The electric coupling between neighboring layers facilitates decoupling of achievable amplitude and phase shift patterns.

The phase patterns achievable using a phase element of the present invention can be used to split the incoming electromagnetic beam into two or more beams, reshape/apodize/redirect the beam and so on. In general, any beam transformation achievable with a holographic element is also achievable with an element of the present invention which, in this respect, functions as a holographic element. Flat (low-profile) antennas and antennas hidden from view can be constructed using a phase element of the present invention.

The following general steps (a) to (d) can be followed to manufacture a phase element of the present invention:

(a) selecting a material and a thickness for each of the layers of the stack of alternating conductive and dielectric layers;

(b) selecting the number of the conductive layers in the stack;

(c) performing an electromagnetic simulation of the stack to obtain a dependence of a phase shift value on the spatially varying feature; and (d) patterning the conductive layers to obtain the predetermined phase shift pattern, based on the dependence obtained in step (c).

Figure 17:
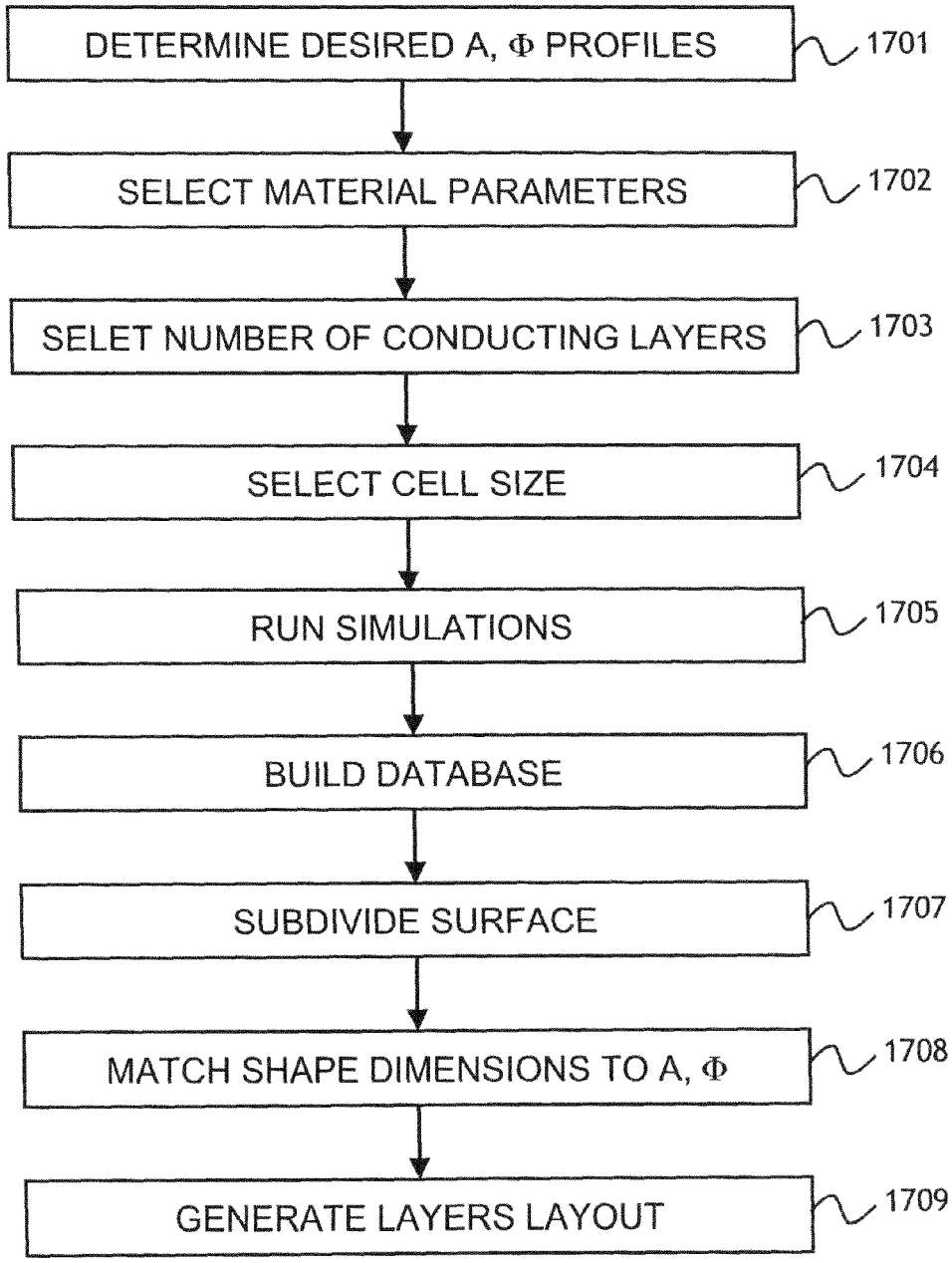
FIG. 17 is a block diagram of steps for manufacturing a phase element of the present invention.

Referring now to FIG. 17, a detailed breakdown of steps (a) to (d) for manufacturing the phase elements 200, 400, 500, 700, 800, 1000, 1100A, 1100B, or 1400 is presented.

At a step 1701, the desired amplitude and phase (denoted as A and Φ) profile of the phase element is determined. This can be done using any readily available standard analytical electromagnetic or optical technique used for a lens or a grating design.

At a step 1702, the substrate dielectric constant and thickness to be used in the phase element are selected. In practice, these values are selected based on commonly available microwave substrate materials. Typically, the dielectric constant of between 2 and 3 is selected, but higher values can be used as well. The substrate thickness depends on the wavelength of the electromagnetic beam. A value of 0.05 of the wavelength is typical.

At a step 1703, the number of conducting (typically copper) layers is selected. The number of layers will depend on the required phase and or amplitude shift ranges. If only a phase shifting is required, then a minimum of two conductive layers are needed. Three layers are usually required to realize the full range of phase values with minimum transmission loss. If both phase and amplitude variations are required, then a minimum of three conductive layers is needed, but four conductive layers are preferable to achieve a much broader range of phase and amplitude variation.

At a step 1704, an appropriate unit cell size is selected. For example, the cell height s is selected at this step. The unit cell is used in the subsequent analysis of the phase element. The phase element is analyzed by placing the various cell elements in an infinite periodic two dimensional array. Typical unit cell dimensions are on the order of a half-wavelength or less, to avoid high quantization errors.

At a step 1705, full-wave electromagnetic simulations of the unit cell are run with proper electromagnetic boundaries to emulate an infinite periodic structure. The simulations of conducting features of dimensions and shapes are performed.

At a step 1706, a database mapping the dimensions of the various sets of conducting shapes to the resulting amplitude and phase variations is generated.

At a step 1707, the surface of the phase element is subdivided into unit cells of dimensions corresponding to the simulation cases in the steps 1704 and 1705. For each subdivision or unit cell, the amplitude and phase profile (usually at cell center) is determined based on the amplitude and phase profile pre-determined in the step 1701. In other words, the pre-determined amplitude and phase profile is broken into subdivisions corresponding to the unit cell size.

At a step 1708, the conducting shape dimensions are matched to the corresponding amplitude and phase requirements using the database generated in step 1706, for each conductive layer.

At a step 1709, a layout of each conductive layer of the phase element is generated using a computer-aided design (CAD) tool or any other two-dimensional layout tool. The layout is generated based on the results obtained in the step 1708. When using a photolithographic process such as wet chemical etching, layouts of masks can be generated for each conductive layer to be patterned.

The foregoing description of one or more embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A phase element for introducing a predetermined phase shift pattern into an electromagnetic wave propagating therethrough, the phase element comprising a stack of alternating conductive and dielectric layers each having a thickness, wherein the conductive layers are patterned on individual surfaces of the dielectric layers, the patterned conductive layers each comprising a plurality of features, each feature having a respectively laterally varying dimension, so as to obtain the predetermined phase shift pattern, wherein the thicknesses of each of the dielectric layers are smaller than one tenth of a wavelength of the electromagnetic wave, wherein the total number of the layers in the stack is more than two but less than nine, and wherein at least two neighboring conductive layers of the stack are capacitively and inductively coupled to each other, whereby transmission loss is lessened.

2. The phase element of claim 1, wherein the features of the at least two neighboring conductive layers comprise respective strips, and the laterally varying dimensions are widths of the respective strips.

3. The phase element of claim 2, wherein the widths of the respective strips are smaller than one half of the wavelength.

4. Use of the phase element of claim 1 in a low-profile antenna.

5. The phase element of claim 1, wherein the total number of the layers in the stack is three, including two of the conducting layers and one dielectric layer therebetween, and wherein an achievable phase shift range is from 0 degrees to 120 degrees of phase at the transmission loss of less than 1.5 dB.

6. The phase element of claim 1, wherein the total number of the layers in the stack is five, including three of the conducting layers and two of the dielectric layers therebetween, and wherein an achievable phase shift range is from 0 degrees to 300 degrees of phase at the transmission loss of less than 2.5 dB.

7. The phase element of claim 1, wherein the total number of the layers in stack is seven, including four of the conducting layers and three of the dielectric layers therebetween, and wherein an achievable phase shift range is from 0 degrees to 360 degrees of phase at the transmission loss of less than 2 dB.

8. The phase element of claim 1, wherein the capacitive coupling of the at least two neighboring conductive layers is characterized by an interlayer capacitance, wherein the interlayer capacitance is equal to or greater than 20% of a capacitance between the adjacent features of the plurality of features of one of the two neighboring conductive layers, the adjacent features having the laterally varying dimensions.

9. The phase element of claim 1, having a total thickness of the conducting and the dielectric layers of less than one third of the wavelength.

10. The phase element of claim 1, wherein the stack includes two first and second patterned conductive layers, wherein the laterally varying dimensions of the features of the first patterned conductive layer are different from the laterally varying dimensions of the features of the second patterned conductive layer.

11. The phase element of claim 1, wherein the features of the conductive layers include conductive strips running parallel to each other, whereby the predetermined phase shift and the transmission loss are polarization-dependent, wherein the conductive strips are spaced apart by gaps, and wherein a width of at least one of the conductive strips or a width of at least one of the gaps varies therealong, so as to obtain the predetermined phase shift pattern.

12. The phase element of claim 1, wherein the features of the conductive layers include conductive rectangles, whereby the predetermined phase shift and the transmission loss are substantially polarization independent, wherein the rectangles are separated from each other by gaps, and wherein at least some of the rectangles have different dimensions and, or different gaps therebetween, so as to obtain the predetermined phase shift pattern.

13. The phase element of claim 1 for introducing a predetermined amplitude shift pattern into the electromagnetic wave propagating therethrough, wherein the pluralities of features of the at least two neighboring conductive layers spatially vary so as to obtain the predetermined amplitude shift pattern.

14. The phase element of claim 13, wherein the predetermined amplitude shift pattern and the predetermined phase shift pattern are selectable substantially independently on each other.

15. The phase element of claim 14, wherein the capacitive coupling of the at least two neighboring conductive layers is characterized by an interlayer capacitance, wherein the interlayer capacitance is equal to or greater than 20% of a capacitance between adjacent features of the plurality of spatially varying features of a same one of the at least two neighboring conductive layers.

16. The phase element of claim 1, wherein the predetermined phase pattern is selected so as to split the electromagnetic wave to propagate in at least two different directions.

17. Use of the phase element of claim 1 in an antenna that is hidden from view.

18. A phase element for introducing a predetermined phase shift pattern into an electromagnetic wave propagating therethrough, the phase element comprising a stack of alternating conductive and dielectric layers each having a thickness, the stack including first and second neighboring conductive layers, wherein the first and the second conductive layers are patterned on individual surfaces of the dielectric layers, so as to form a plurality of conductive shapes capacitively coupled to the respective neighboring shapes disposed in the same conductive layer, thereby forming two-dimensional patterns of first and second capacitances, respectively, and wherein the conductive shapes of the first conductive layer are capacitively and inductively coupled to the respective neighboring conductive shapes disposed in the second conductive layer of the stack, whereby the conductive shapes of the first and the second conductive layers form a two-dimensional pattern of transmission lines extending through the stack, wherein each transmission line comprises a succession of a first capacitance of the two-dimensional pattern of first capacitances, capacitively and inductively coupled to a second capacitance of the two-dimensional pattern of second capacitances, wherein the first and the second capacitances are selected so as to introduce the predetermined phase shift pattern into the electromagnetic wave propagating through the phase element.

19. The phase element of claim 18, wherein the stack further comprises a third conductive layer neighboring the second conductive layer, wherein the third conductive layer is patterned on a surface of one of the dielectric layers, so as to form a plurality of conductive shapes capacitively coupled to the respective neighboring shapes disposed in the third conductive layer, thereby forming a two-dimensional pattern of third capacitances, wherein the conductive shapes of the third conductive layer are capacitively and inductively coupled to the respective neighboring conductive shapes disposed in the second conductive layer of the stack, whereby the transmission lines comprise a succession of capacitively and inductively coupled the first, the second, and the third capacitances, wherein the third capacitances are selected so as to introduce the predetermined phase shift pattern into the electromagnetic wave propagating through the phase element.

20. The phase element of claim 18, wherein the conductive shapes of the first conducting layers form a two-dimensional pattern of interlayer capacitances with the respective neighboring conductive shapes disposed in the second conductive layer of the stack, wherein the interlayer capacitances are equal to or greater than 20% of the corresponding first or second capacitances, whichever is less.

* * * * *